United States Patent [19]

Rudick et al.

[11] Patent Number: 4,709,734

[45] Date of Patent: Dec. 1, 1987

[54] METHOD AND SYSTEM FOR FILLING PACKAGES WITH A CARBONATED BEVERAGE PRE-MIX UNDER MICRO-GRAVITY CONDITIONS

[75] Inventors: Arthur G. Rudick, Marietta; William S. Credle, Jr., Stone Mountain, both of Ga.

[73] Assignee: The Coca-Cola Company, Atlanta, Ga.

[21] Appl. No.: 777,316

[22] Filed: Sep. 18, 1985

Related U.S. Application Data

[63] Continuation-in-part of Ser. No. 724,155, Apr. 17, 1985.

[51] Int. Cl.[4] ..... B65B 3/04

[52] U.S. Cl. ..... 141/2; 141/18; 222/386.5

[58] Field of Search ..... 141/1-12, 141/18-29, 37-64; 222/386.5; 261/DIG. 7

[56] References Cited

U.S. PATENT DOCUMENTS

| | | | |
|---|---|---|---|
| 2,816,690 | 12/1957 | Lari | 141/2 |
| 3,233,779 | 2/1966 | Cornelius | 222/52 |
| 3,593,760 | 7/1971 | Beffel | 141/3 |
| 4,328,843 | 5/1982 | Fujii | 141/3 |

*Primary Examiner*—Houston S. Bell, Jr.

*Attorney, Agent, or Firm*—Birch, Stewart, Kolasch & Birch

[57] ABSTRACT

A system and method for filling or refilling a drinking container with a carbonated beverage pre-mix in outer space. The drinking containers are refilled from a master supply tank which is maintained at a substantially constant pressure which keeps the carbonation of the pre-mix in the tank in solution.

14 Claims, 4 Drawing Figures

METHOD AND SYSTEM FOR FILLING PACKAGES WITH A CARBONATED BEVERAGE PRE-MIX UNDER MICRO-GRAVITY CONDITIONS

This application is a continuation-in-part Application of prior application Ser. No. 724,155, filed Apr. 17, 1985, assigned to the same assignee as the present invention.

BACKGROUND OF THE INVENTION

The present invention relates to a system and method for filing a package of the type described in the above-referenced parent application in the flight compartment of a space ship or the like under micro-gravity conditions.

It is known that under zero or micro-gravity conditions of outer space, that beverages cannot be poured from a vessel directly into a consumer's mouth. They must be forced out of the vessels or packages, under pressure, directly into the mouth of the consumer or astronaut. For still beverages and water, the astronaut can suck the liquid from a collapsible container through a straw.

Furthermore, the container utilized for dispensing a food or beverage must be of a collapsible volume type in order to preclude the creation of an air space or pocket within the container, the location of which cannot be controlled due to the substantially zero gravity conditions.

The package described in the aforementioned parent application was developed for dispensing a carbonated beverage pre-mix in outer space directly into an astronaut's mouth.

The pre-mix package described in that parent application can be filled on earth before it is launched into outer space. However, it would be desirable to provide a system to refill empty packages with pre-mix from a master supply tank in outer space operable by the crew of astronauts.

SUMMARY OF THE INVENTION

Accordingly, it is a primary object of the present invention to provide a system and method for filling packages for carbonated beverage pre-mix in the micro-gravity conditions of outer space.

It is another object of the present invention to provide a system and method for filling pre-mix packages which may be easily operated and performed by astronauts or the crew of a space ship in a quick, efficient manner.

The objects of the present invention are fulfilled by providing a system for filling packages with a carbonated beverage pre-mix in the micro-gravity conditions of outer space comprising:

(a) a package including, a rigid container, a collapsible bag disposed within the rigid container said bag containing the carbonated beverage pre-mix, a drinking spout for dispensing said carbonated beverage directly into the consumer's mouth, a valve associated with said spout for starting or stopping the flow of carbonated beverage therethrough, valve actuator means for opening or closing said valve to start or stop said flow, respectively, propellant gas means disposed in said rigid container around said collapsible bag for compressing said bag and forcing said carbonated pre-mix to flow through said spout when said valve is open, said propellant gas means having a sufficient initial pressure to ensure that the carbonation of said carbonated beverage pre-mix remains in solution throughout the dispensing period of the package, and flow-rate control means for maintaining a substantially constant rate of flow of the carbonated beverage pre-mix from said bag through said drinking spout; and (b) a supply tank containing a sufficient quantity of carbonated beverage pre-mix to fill a plurality of said packages, said tank including,
1. an outer rigid shell,
2. a collapsible supply bag for containing said quantity of carbonated pre-mix,
3. a dip tube extending into said bag having a conduit for accommodating the flow of the pre-mix therethrough,
4. a source of gas under pressure in the rigid outer shell for pressing the walls of the supply bag against the pre-mix, the pressure of said gas being substantially constant and sufficient to maintain the carbonation of the pre-mix in solution, and
5. a valve assembly for coupling the dip tube of the supply tank to the spout of said package.

BRIEF DESCRIPTION OF THE DRAWINGS

The objects of the present invention and the attendant advantages thereof will become more readily apparent with reference to the drawings, like reference numerals referring to like parts, wherein:

Referring to FIG. 1, which is a side-elevational view in section of the micro-gravity package described in parent application Ser. No. 724,155, filed Apr. 17, 1985, there is illustrated the interior details of the package including a flexible plastic bag 3 with a plastic molded spout. The bag may be fabricated from polyethylene, metalized polyester or the like, which contains the carbonated beverage pre-mix to be dispensed. In FIG. 1, the collapsible bag 3 is substantially full. Surrounding the collapsible bag 3 in the space between the outside thereof and the inner walls of the rigid outer container 2, is pressurized carbon dioxide gas which has been introduced through a plug 13 in the bottom of container 2. The pressure of this carbon dioxide gas must be sufficiently high so that the carbonation of the pre-mix within bag 3 is maintained throughout the period of dispensing of the same. That is, the initial pressure of the $CO_2$ gas surrounding bag 3 is chosen so that the pre-mix will maintain $CO_2$ in solution from a "full" condition of the bag 3 to a substantially "empty" condition. Accordingly, the quality of the carbonated beverage is maintained from start to finish.

Figure 1:
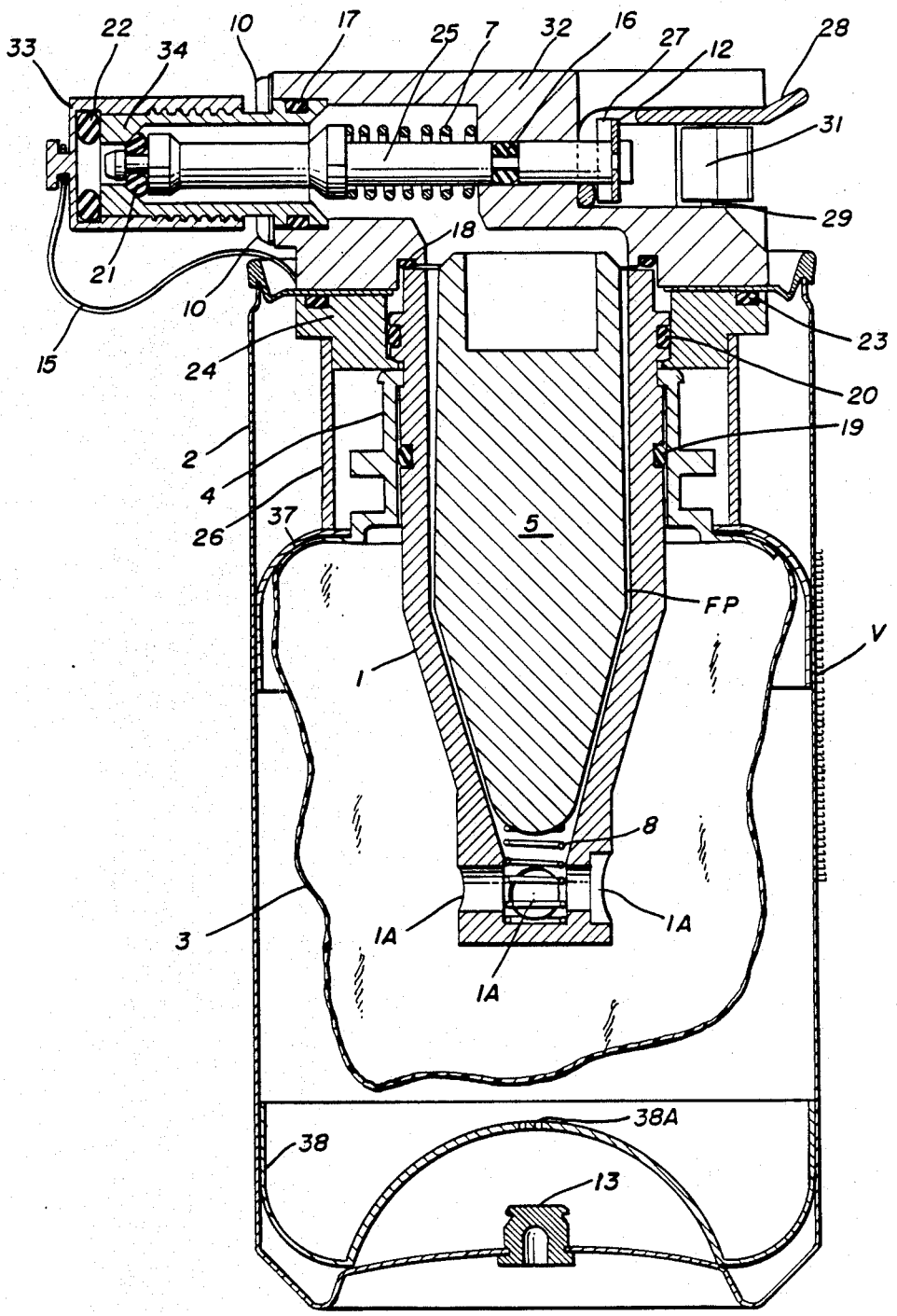
FIG. 1 is a cross-sectional view in side elevation of the carbonated beverage pre-mix package disclosed in parent application Ser. No. 724,155, filed Apr. 17, 1985.

A valve assembly is secured to the top of the package through an opening in the top of container 2 by a retainer 24. An O-ring seal 23 is provided between retainer 24 and the inside wall of the top of container 2.

Retainer 24 also supports the outer, tubular housing 1 of a flow-rate control device in a position extending to the interior of collapsible bag 3. The bottom end of tubular housing 1 is provided with inlet openings 1A for accommodating the flow of the carbonated beverage pre-mix into the tubular housing 1. A complementary-shaped piston 5 is disposed within tubular housing 1. This piston is bullet-shaped, as illustrated, having an upper cylindrical portion and a lower cone-shaped portion. The bullet-shaped piston 5 is supported in spaced proximity to the inner walls of tubular housing 1 by a coil spring 8 sandwiched between the bottom of the piston and the bottom of the complementary-shaped tubular housing. This spring 8 precludes movement of the piston 5 downwardly to prevent the flow passage FP between the outer sidewalls of plunger 5 and the inner sidewalls of the tubular housing 1 from closing when the container is being filled. The side of passage FP is manually adjustable to a predetermined size commensurate with a desired flow rate. Therefore, a consumer drinking from the spout 34 will not sense any appreciable variation of flow rate, which might cause discomfort or indigestion.

The bag 3 is supported within the container 2 from a plastic fitment or spout 4 which is, in turn, secured to the outer tubular housing 1 of the flow-rate control device. Appropriate O-ring seals 19 and 20 are provided around the exterior of the tubular housing 1 in order to preclude the flow of fluid between the bag spout or the retainer 24, respectively. A spacer 26 with a baffle portion 37 is provided between retainer 24 and the upper portions of the bag 3 and spout 4 to keep the main portion of the bag disposed below and spaced from the openings 1A, regardless of the volume of pre-mix contained in the bag. A baffle 38 with ports 38A is also provided at the bottom of container 2 to keep bag 3 from breaking on plug 13.

Openings 1A should be sized so that bag 2 will not collapse into a break on the edges thereof. In an alternative embodiment, openings 1A may have plugs therein containing a plurality of spaced small apertures.

The dispensing valve is formed by an O-ring 21 at the end of a plunger 25, which seats against the inside surface of the drinking spout 34 adjacent the outlet opening thereof. Plunger 25 is spring-biased to a normally closed position by a coil spring 7. A valve-actuating lever 28, coupled to the distal end of plunger 25 from the drinking spout 34 through a washer 27 by a snap-ring 12, is provided for opening and closing the valve to initiate or stop the flow of beverage from the spout 34. In the position illustrated in FIG. 1, the valve is closed, and the lever 28 is locked in its unactuated position. FIG. 1 also shows, in cross-section, appropriate O-ring seals 22, 17 and 16 spaced along the valve housing about the plunger 25.

Figure 2:
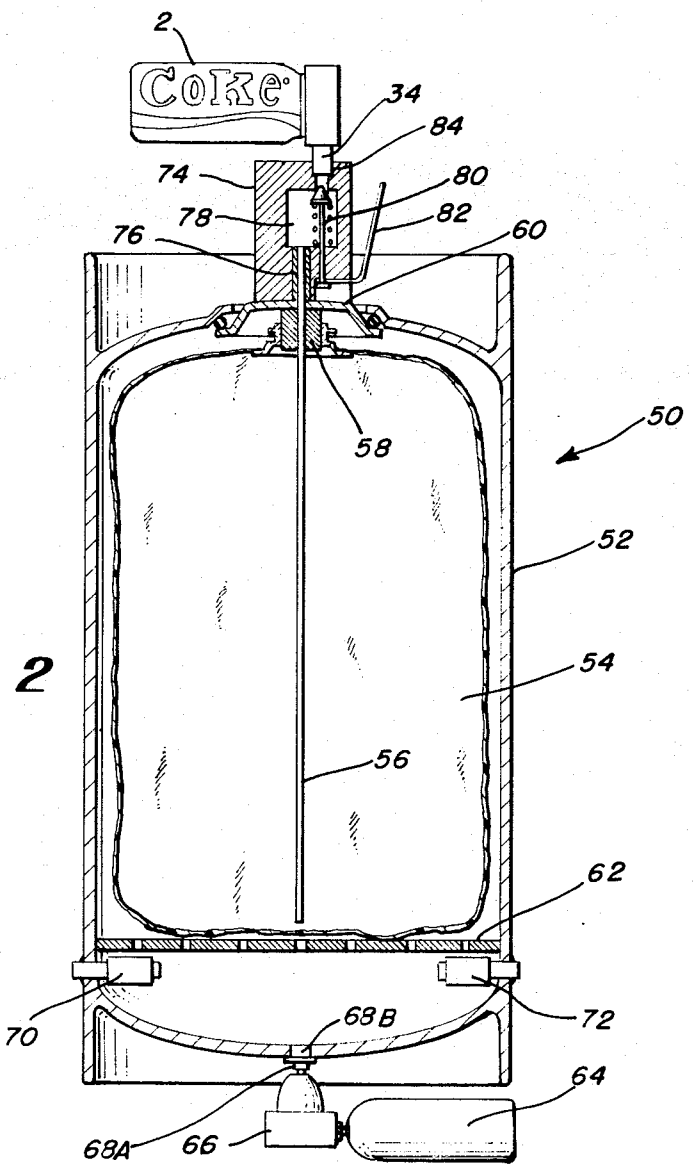
FIG. 2 is a cross-sectional view in side elevation of a system including a carbonated beverage pre-mix supply tank coupled to the package of FIG. 1 for filling the pre-mix package with a carbonated pre-mix beverage.

Referring to FIG. 2, there is illustrated the system and method of the present invention for filling a pre-mix package 2 of the type described in the aforementioned parent application and illustrated in FIG. 1, with carbonated pre-mix beverage. A supply tank 50 includes an outer rigid shell 52 and an inner collapsible bag 54 in which a sufficient quantity of carbonated beverage pre-mix is contained. The container 52 is preferably a conventional five-gallon (hereinafter FIGAL) container. The FIGAL container 52 has a modified lid assembly 60 for operative association with a bag fitment 58 for bag 54 and a valve assembly 74 which rests on the top thereof. Adjacent the bottom of the tank are pressure relief valves 70 and 72. The purpose of these relief valves will be discussed in more detail hereinafter.

The bag 54 is supported by a bag fitment 58 which is secured to the opening of the bag by appropriate means. A dip tube 56 passes through the fitment 58 into the interior of bag 54, and also has one end which fits into a socket 76 in the bottom of valve assembly 74.

The FIGAL container 52 or the outer rigid shell of the supply tank is filled with a counter-pressure gas supplied from a $CO_2$ cylinder 64 through a pressure regulator 66 and a nozzle 68A. Nozzle 68A fits into a coupling 68B in the bottom of the tank, which passes through the bottom wall to permit the flow of gas into the FIGAL 52. Once the gas is introduced into the FIGAL 52, it passes through apertures in the bag support plate 62 and surrounds the collapsible bag 54, applying pressure to the sidewalls thereof which presses against the pre-mix beverage contained within the bag. Accordingly, the $CO_2$ gas introduced into the FIGAL 52 from cylinder 64 pressurized the pre-mix. The pressure of the $CO_2Y$ gas introduced into the tank is regulated by pressure regulator 66, to be approximately 60 p.s.i. This pressure is substantially constant and sufficient to hold the carbonation of the pre-mix within bag 54 in solution, and also to propel the pre-mix from the bag through dip tube 56 when the valve 74 is opened, to force the pre-mix into the package 2 being filled.

As an alternate embodiment, the cylinder 64 and the regulator 66 could be placed inside the FIGAL below the bag support plate 62. In this configuration, nozzle 68A and coupling 68B are not necessary as $CO_2$ exiting the regulator goes straight into the FIGAL interior. Placing the cylinder inside of the FIGAL provides extra protection in the event of cylinder failure.

As a safety feature, the bottom sidewalls of the FIGAL 52 are provided with pressure relief valves at 70 and 72. For example, the pressure relief valve 70 could be set at 70 p.s.i. to vent the FIGAL 52 to the atmosphere if the pressure exceeded this level. For added safety, the pressure reliev valve 72 could be set at 90 p.s.i. to vent the FIGAL 52 to the atmosphere in the event that pressure relief valve 70 should fail.

The valve assembly 74 includes a lower socket 76 for receiving the upper end of dip tube 56, a valve chamber 78, a spring-loaded valve poppet 80 within the valve chamber, a valve-actuating lever 82 for opening the valve poppet 80, and a socket 84 into which the spout 34 may be plugged, to place the package 2 to be filled in fluid communication with the interior of the flexible bag 54.

Figure 3:
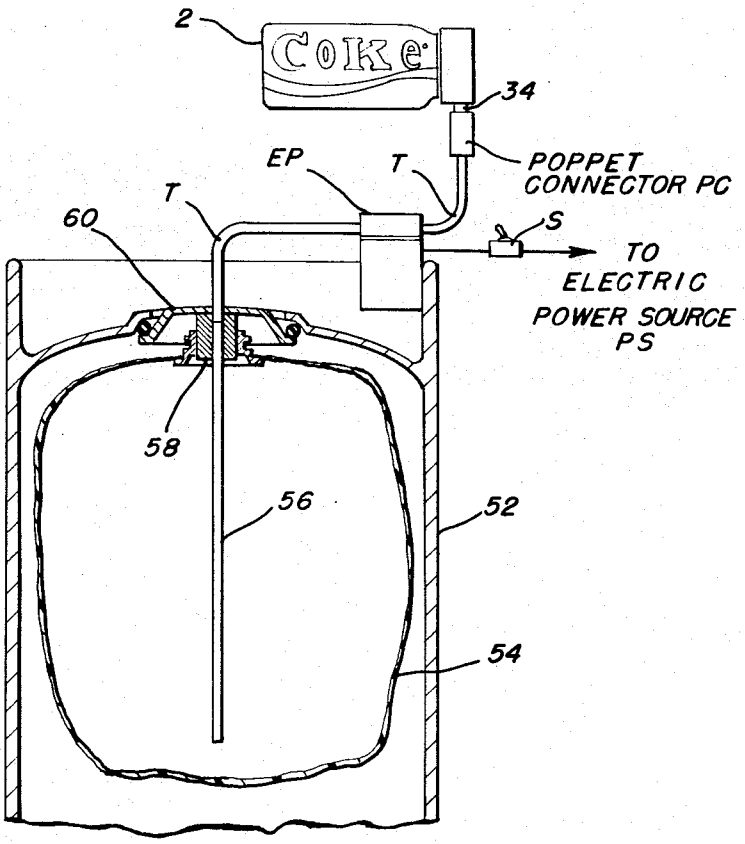
FIG. 3 is a partial section of an alternative embodiment to the system illustrated in FIG. 2, for filling a pre-mix package with carbonated beverage.

FIG. 3 shows an alternate embodiment of the present invention wherein the valve assembly 74 is replaced with an electric pump EP connected to the dip tube 56 and the spout 34 of the pre-mix package 2 through flexible tubing T and a poppet connector PC. The electric pump EP is turned on and off by electric switch S connected to a power source PS when it is desired to withdraw the pre-mix beverage from the thin bag 54 up dip tube 56 and into the spout 34 of the pre-mix package 2.

Even with an electric pump, the FIGAL must start with a sufficient initial counterpressure to keep the $CO_2Y$ in solution in the pre-mix in the bag until the bag is empty, even though the system does not rely on the counterpressure to force the pre-mix out of the bag.

The preferred method of filling a pre-mix package such as 2 of the present invention can be best understood by reference to FIG. 2. When it is desired to fill a package 2, an astronaut will simply plug the spout 34 into socket 84 of valve assembly 74. The FIGAL container 52 will be pressurized by the $CO_2$ cylinder 64, which is connected through the pressure regulator 66, and nozzle 68A to the coupling 68B in the bottom of the container. The container will already have sufficient pressure to maintain the carbonation of the pre-mix of a full bag 54 in solution; but the constant pressure provided by the $CO_2$ within the cylinder 64, as regulated by regulator 66, will create a sufficient pressure within the container to propel the pre-mix within bag 44 up the dip tube 56 when valve assembly 74 is opened. Note that the $CO_2$ cylinder (or the compressor) will always keep the counterpressure at an essentially constant value throughout and in between each dispensing cycle. Because of the constant pressure, the carbonation will remain in solution in the pre-mix regardless of the volume of pre-mix in the bag. Once the FIGAL is appropriately pressurized, as described, the astronaut will simply actuate lever 82, opening poppet 80 and permitting the pre-mix beverage to flow through spout 34 into package 2. When package 2 becomes full, it may be removed for immediate consumption of the beverage or storage until consumption is desired.

Figure 4:
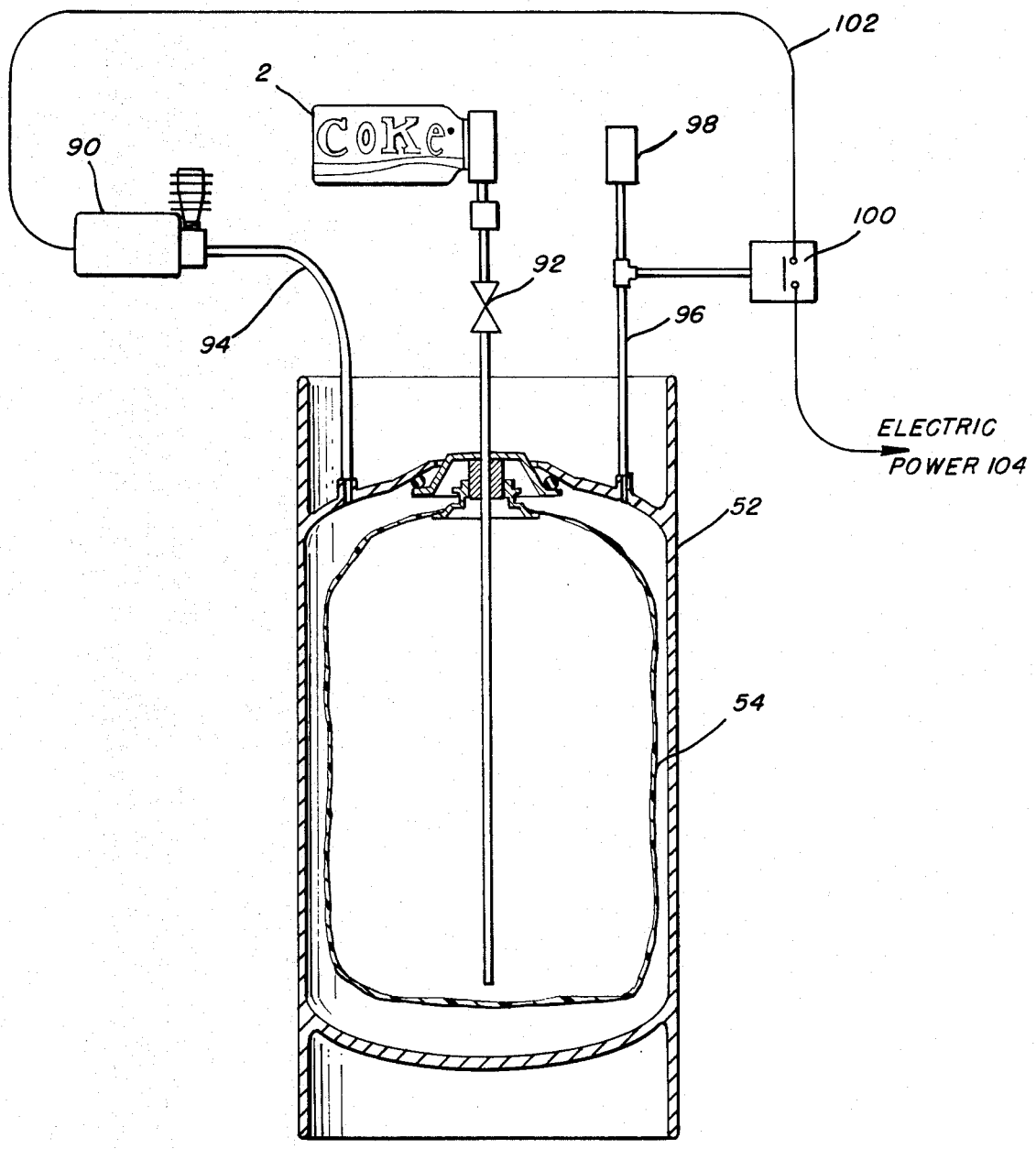
FIG. 4 is a diagramattic illustration of a further embodiment of the present invention.

FIG. 4 illustrates an additional alternative full, it may be removed for immediate consumption of the beverage or storage until consumption is desired.

FIG. 4 illustrates an additional alternative embodiment of the present invention of filling can 2. Air pressure within FIGAL 52 is maintained at approximately 60 p.s.i. by a compressor 90 coupled to the interior of the FIGAL through a hose 94. Compressor 90 is coupled to an electrical pressure switch 100 through wire 102. Pressure switch 100 is set to turn compressor 90 on when the pressure sensed through hose 96 in communication with the interior of the FIGAL drops below 60 p.s.i. and turns the compressor 90 off when the pressure exceeds 60 p.s.i. In this manner, a constant pressure of 60 p.s.i. is maintained within FIGAL 52. Electric power is provided at line 104. A manually operable valve 92 is opened when it is desired to fill can 2 with the pre-mix in bag 54. A pressure relief valve 98 set at 70 p.s.i. is provided in line 96 for safety.

It should be understood that the apparatus described herein may be modified as would occur to one of ordinary skill in the art without departing from the spirit and scope of the present invention.

What is claimed is:

1. A method for filling packages with a carbonated beverage pre-mix in the micro-gravity conditions of outer space, each package including a rigid container, a collapsible bag disposed within the rigid container, said bag containing the carbonated beverage pre-mix, a drinking spout for dispensing said carbonated beverage directly into the consumer's mouth, a valve associated with said spout for starting or stopping the flow of carbonated beverage therethrough, valve actuator means for opening or closing said valve to start or stop said flow, respectively, propellant gas means disposed in said rigid container around said collapsible bag for compressing said bag and forcing said carbonated pre-mix to flow through said spout when said valve is open, said propellant gas means having a sufficient initial pressure to ensure that the carbonation of said carbonated beverage pre-mix remains in solution throughout the dispensing period of the package, and flow-rate control means for maintaining a substantially constant rate of flow of the carbonated beverage pre-mix from said bag through said drinking spout, comprising the steps of:

(a) providing a supply tank containing a sufficient quantity of carbonated beverage pre-mix to fill a plurality of said packages, said tank including,
   1. an outer rigid shell,
   2. a collapsible supply bag for containing said quantity of carbonated beverage pre-mix;
   3. a dip tube extending into said supply bag having a conduit for accommodating the flow of the pre-mix therethrough;
   4. a source of gas under pressure in the rigid outer shell for pressing the walls of the supply bag against the pre-mix, the pressure of said gas being substantially constant and sufficient to maintain the carbonation of the pre-mix in solution, and
   5. a valve assembly for coupling the dip tube of the supply tank to the spout of said package; and (b) connecting the spout of a package to said valve assembly; and (c) actuating said valve assembly to fill a package with said pre-mix.

2. The method of claim 1, wherein the gas in the rigid outer shell of the supply tank is provided from a $CO_2$ cylinder and a pressure regulator, the cylinder containing just enough gas to maintain pressure of about 60 p.s.i. on the wall from a full to an empty condition of the bag.

3. The method of claim 1, wherein said valve assembly includes an upwardly-facing socket for receiving the spout of said package, whereby said spout may be plugged into said socket to connect the spout to the valve assembly.

4. The method of claim 1, wherein the outer rigid shell of the tank includes pressure relief means for venting pressures in the shell to the atmosphere which exceed the gas pressure in the shell by a predetermined amount.

5. The method of claim 2, wherein said pre-mix is forced through the dip tube by the pressure of the gas in the rigid outer shell.

6. The method of claim 1, wherein an electric pump is provided between the dip tube and said package to withdraw the pre-mix from the supply bag through the dip tube and into the spout of the package.

7. A system for filling packages with a carbonated beverage pre-mix in the micro-gravity conditions of outer space comprising:

(a) a package including, a rigid container, a collapsible bag disposed within the rigid container, said bag containing the carbonated beverage pre-mix, a drinking spout for dispensing said carbonated beverage directly into the consumer's mouth, a valve associated with said spout for starting or stopping the flow of carbonated beverage therethrough, valve actuator means for opening or closing said valve to start or stop said flow, respectively, propellant gas means disposed in said rigid container around said collapsible bag for compressing said bag and forcing said carbonated pre-mix to flow through said spout when said valve is open, said propellant gas means having a sufficient initial pressure to ensure that the carbonation of said carbonated beverage pre-mix remains in solution throughout the dispensing period of the package, and flow-rate control means for maintaining a substantially constant rate of flow of the carbonated beverage pre-mix from said bag through said drinking spout; and (b) a supply tank containing a sufficient quantity of carbonated beverage pre-mix to fill a plurality of said packages, said tank including, 1. an outer rigid shell,
2. a collapsible supply bag for containing said quantity of carbonated beverage pre-mix,
3. a dip tube extending into said bag having a conduit for accommodating the flow of the pre-mix therethrough,
4. a source of gas under pressure in the rigid outer shell for pressing the walls of the supply bag against the pre-mix, the pressure of said gas being sufficient to maintain the carbonation of the pre-mix in solution, and
5. a valve assembly for coupling the dip tube of the supply tank to the spout of said package.

8. The system of claim 7 wherein the gas in the rigid outer shell of the supply tank is provided from a $CO_2$ cylinder and a pressure regulator, the cylinder containing just enough gas to maintain a pressure of about 60 p.s.i. on the wall from a full to an empty condition of the bag.

9. The system of claim 7, wherein said valve assembly includes an upwardly-facing socket for receiving the spout of said package, whereby said spout may be plugged into said socket to connect the spout to the valve assembly.

10. The system of claim 7, wherein the outer rigid shell of the tank includes pressure relief means for venting pressures in the shell to the atmosphere which exceed the gas pressure in the shell by a predetermined amount.

11. The system of claim 7, wherein said pre-mix is forced through the dip tube by the pressure of the gas in the rigid outer shell.

12. The system of claim 7, wherein an electric pump is provided between the dip tube and said package to withdraw the pre-mix from the supply bag through the dip tube and into the spout of the package.

13. The method of claim 1 wherein the gas in the rigid outer shell of the supply tank is maintained at said constant pressure by a compressor, said compressor being turned ON and OFF by a pressure sensor which monitors pressure changes in said gas.

14. The system of claim 7 wherein the gas in the rigid outer shell of the supply tank is maintained at said constant pressure by a compressor, said compressor being turned ON and OFF by a pressure sensor which monitors pressure changes in said gas.

* * * * *